United States Patent [19]

Clark

[11] 4,221,552

[45] Sep. 9, 1980

[54] HYDRAULIC MOTOR WITH VARIABLE SPEED

[76] Inventor: Wallace Clark, 1830 S. German Church Rd., Indianapolis, Ind. 46239

[21] Appl. No.: 961,978

[22] Filed: Nov. 20, 1978

[51] Int. Cl.[3] ..... F03C 2/00; E21B 4/02

[52] U.S. Cl. ..... 418/48; 418/166; 175/107

[58] Field of Search ..... 418/48, 166; 175/107

[56] References Cited

U.S. PATENT DOCUMENTS

| | | | |
|---|---|---|---|
| 3,443,482 | 5/1969 | Lummus et al. | 418/48 |
| 3,938,915 | 2/1976 | Olofsson | 418/166 |
| 4,080,115 | 3/1978 | Sims et al. | 418/48 |

FOREIGN PATENT DOCUMENTS

| | | | |
|---|---|---|---|
| 427475 | 4/1935 | United Kingdom | 418/48 |
| 237596 | 2/1969 | U.S.S.R. | 418/48 |

*Primary Examiner*—John J. Vrablik
*Attorney, Agent, or Firm*—Frost & Jacobs

[57] ABSTRACT

A hydraulic motor is disclosed using the helical gear elements as taught by Moineau in his early patents, as for example, U.S. Pat. No. 1,892,217 of Dec. 27, 1932. In the present invention the internal element of the Moineau pair is held against gyration but is permitted to rotate freely. The outer member of the Moineau gear pair is caused to turn without gyration when fluid is pumped through the motor. Compared with conventional Moineau gear pair motors, the volume of liquid to be pumped through the motor is reduced by 50% and therefore the fluid may be pumped at a higher pressure than is available with current Moineau gear pair motors. If the pressure is doubled, then the torque put out by the motor is doubled. While the device is useful in various applications, it is of particular value in connection with well drilling down-hole motors.

8 Claims, 3 Drawing Figures

HYDRAULIC MOTOR WITH VARIABLE SPEED

CROSS-REFERENCE TO RELATED APPLICATIONS

This application is related to an application in the name of Wallace Clark, Ser. No. 914,776 filed June 12, 1978, and an application in the names of Wallace Clark and Albert S. Goldstein, Jr., Ser. No. 958,647, filed Nov. 8, 1978, which is continuation-in-part of Ser. No. 878,814, filed Feb. 17, 1978.

BACKGROUND OF THE INVENTION

In conventional pumps or motors employing Moineau gear pairs, the inner member and the outer member move with respect to each other. If the outer member is held stationary, the inner member rotates and gyrates within the outer member. If the inner member is held stationary, the outer member rotates and gyrates with respect to the inner member. Since the outer element has a number of threads differing by one from the number of threads on the inner element, a series of pumping pockets is provided between the inner and outer elements, and these pockets move through the pump or motor in a helical path. The axes of the inner and outer members are parallel but displaced by an amount designated as the eccentricity of the pump or motor.

In one of the early Moineau U.S. Pat. No. 2,505,136, granted Apr. 25, 1950, it was taught that the inner member of the gear pair could rotate on its own axis without gyration, and the outer member was also free to rotate on its own axis, the axes being separated by the eccentricity of the pump. In this case, the pumping pockets, instead of traveling in a helical path, move straight through the pump axially.

The device of the Moineau U.S. Pat. No. 2,505,136 proved to be most inefficient. Because of the fact that both the inner and outer elements were rotating, the volume pumped by the pump was approximately one-half of what would be pumped by another conventional Moineau gear pair where one or the other of the gear elements was held stationary against rotation. Therefore, the device of this patent never went into use because of this inefficiency. While Moineau indicated in earlier patents that his devices could function as a pump if one of the gear elements was driven, he also indicated that it could function as a hydraulic motor if a liquid was pumped through the device. However, in the U.S. Pat. No. 2,505,136, Moineau did not discuss the possibility of using his device as a motor.

Because of this inefficiency, this patent turned out to be what might be referred to as a paper patent and never went into use and was forgotten.

In Clark U.S. Pat. No. 4,059,165, dated Nov. 22, 1977, there is taught a versatile fluid motor and pump which when two of the devices are coupled together make it possible to decrease the speed of the motor which is connected to the drill bit and thereby increase the torque. However, this requires the assembly of two hydraulic motors, as taught in that patent.

According to the present invention, the result of higher torque and decreased speed is accomplished with a single hydraulic motor.

If it were attempted to use directly the teachings of the Moineau U.S. Pat. No. 2,505,136, and use the device shown in FIG. 3 as a motor rather than a pump, the result would be very unsatisfactory because the drill bit would have to be secured to the member which is rotating on an axis central of the pipe 40, and this is the thinnest part of the device. Furthermore, the outer gear member 44 would be offset to one side of the pipe 40 which would create an unbalance and blockage of the annulus by a rotating wall contact and thus an entirely unsatisfactory device.

BRIEF SUMMARY OF THE INVENTION

According to the present invention, use is made of the general principle of the Moineau U.S. Pat. No. 2,505,136 but in a reverse situation. That is to say, the output of the motor is the external member of the helical gear pair while the input is the inner member. While the Moineau device was very inefficient as a pump because it only pumped approximately one-half of the expected capacity, (in the case where the threads on the outer and inner members of the gear pair were two and one, respectively) when the device is reversed and used as a hydraulic motor the volume of liquid to be pumped through it to drive it is reduced by 50% and therefore the speed is reduced. Because the volume to be pumped through is reduced by 50%, it may be more easily pumped at a higher pressure, so that if the pressure is doubled the torque put out by the motor is doubled. It is thus possible to provide a down-hole motor for oil well drilling and the like in which a single motor accomplishes what was accomplished by a combination in the Clark U.S. Pat. No. 4,059,165. Obviously if the number of threads on the two members of the gear pair are three and two, or four and three, etc., the speed and torque produced are changed proportionately. The bit may be rotated at a slower speed and at a higher torque with a lower volume of mud pumped through the device.

DETAILED DESCRIPTION

Figure 1:
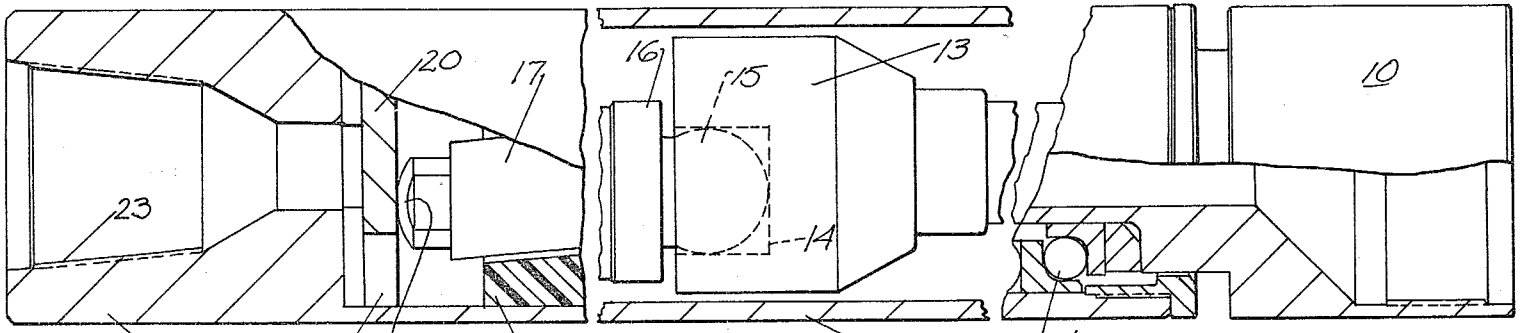
FIG. 1 is a fragmentary view partly in cross section of a hydraulic motor according to the present invention.

As indicated heretofore, while the present device is useful as a motor in various applications, it is particularly useful and will be described as a down-hole motor for use in drilling for oil and the like. In FIG. 1, the hydraulic input connection is indicated at 10. In use as a down-hole motor, this would be the drill stem connection. 11 indicates the water swivel bearing and 12 indicates the water swivel housing. The head 13 is attached to the inner member of the water swivel which is fixed to the drill stem connection. The head 13, of course, is also fixed. The broken lines at 14 indicate a box for cooperation with the ball 15 which in turn is secured to the rotor head 16. Since the head 13 remains fixed and the box 14 remains fixed, the ball 15 is fixed against gyration but is free to turn in the box 14. The inner member of the gear pair is indicated at 17 and the outer member at 18. A thrust button is shown at 19 bearing against a thrust plate 20. The thrust plate has the apertures 21 to permit the passage of drilling mud. The bit box is indicated at 22 and it is to the bit box 22 that the drilling bit is attached by means of the threads 23. It will now be understood that if drilling mud is pumped through the device with the drill stem fixed, the inner member 17 of the Moineau gear pair will only be permitted to rotate and it will rotate on its lathe axis since the ball 15 is disposed on the lathe axis of the inner member 17. The thrust button 19 is not on the lathe axis but on the center of the rotor cross section. Thus, the thrust button will describe a peculiar path as the outer member 18 together with the water swivel housing 12 and the bit box and the bit rotate. The thrust button bears against the thrust plate 20 and its convoluted path is indicated at 24. In this construction, the thrust button 19 will describe the path 24 in the same orientation at all times and over a period of time it will have a tendency to wear a groove in the thrust plate 20, unless from time to time the thrust plate is relieved of load from the pump and allowed to rotate to a new relatively operating position by slightly turning the drill stem. Obviously the button could be mounted at the lathe center to allow it to rotate in one spot only, in the same manner as described in connection with FIG. 3 hereinafter, in which a ball is mounted.

Figure 3:
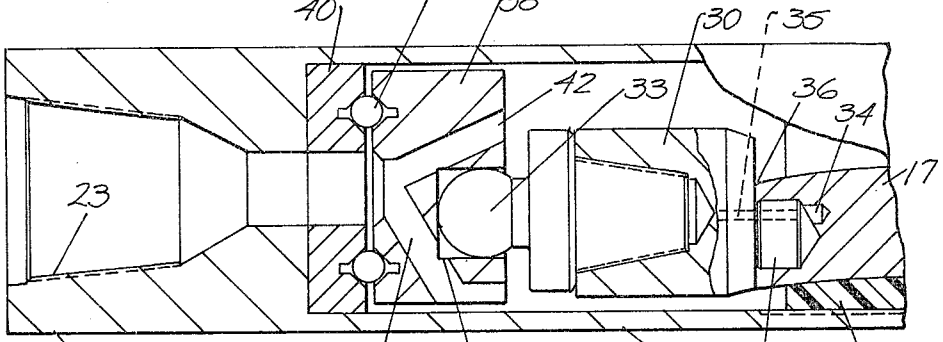
FIG. 3 shows an alternate thrust arrangement like that shown in the Clark and Goldstein application, Ser. No. 958,647 filed Nov. 8, 1978.

As an alternative, the constructions heretofore described in the copending application of Clark and Goldstein, Ser. No. 958,647 filed Nov. 8, 1978, but in the present invention non-rotating, may be used as shown in FIG. 3. Thus, the tail end of the inner member 17 may be supported through a thread mounted head 30, preferably threaded into the center of the cross section of the inner member 17 as indicated at 32.

It is necessary that the head 30 be on the lathe center of the member 17 while, the strength, it is desirable that it be secured to the inner member 17 on the center of its cross section. It is therefore necessary to orient the member 30 into which the ball 33 is threaded and this is accomplished by screwing the head 30 in or out by a small amount and by the provision of a drill hole 34 on the lathe center of the member 17 to serve as a feeler hole. A pin 35 may be passed through a drill hole in the member 30 and the member 30 may then be slowly screwed in or out until the pin 35 on the member 30 can enter the feeler hole 34. At this point, the orientation of the member 30 will be correct and the member is secured in position by means of shims inserted at 36 and by the use of a locking compound on the threads if desired or necessary. This procedure assures that the ball 33 will be on the lathe center of member 17. As in the head end of the inner member 17, the ball 33 operates preferably in a box 37 provided in a member 38 which has a radial and thrust bearing at 39 against the plate 40. In this way, both ends of the inner member 17 are supported on the lathe center of the inner member and the inner member is free to rotate on its lathe center axis with the ball 15 rotating in the box 14 and the ball 33 rotating in the box 37. Again, the pumping of fluid through the device causes the outer member 18 to rotate on the axis of the drill pipe and to drive the outer element of the water swivel at 12 and thus the bit box 22. Apertures for fluid flow are provided at 42.

Figure 2:
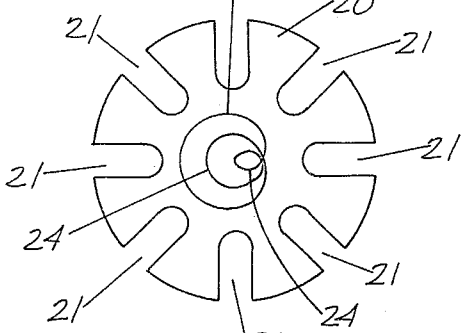
FIG. 2 is a plan view of a thrust plate which may be used with the device of FIG. 1.

From the foregoing description, it will be seen that since the ball 33 is on the lathe center, it will not describe the peculiar path shown in FIG. 2.

The hand of the threads for various uses may be of little importance. However, if the device is used for oil well drilling, it is necessary that the inner and outer elements have right-hand leads of spirals. This results in the bit turning to the right looking down the hole, and makes possible the use of a standard right-hand bit. With the right-hand bit and the drill stem being held against rotation, the tendency is to maintain the tightness of the threads throughout the drill string. If the bit were to turn in the other direction, there would be a tendency to unscrew the joints in the drill string.

Thus, it will be seen that the device of the present invention can do what the device of the Clark U.S. Pat. No. 4,059,165 can do with two hydraulic motors coupled together, but can do it with a single unit. This makes the device simpler and less expensive.

It is well understood in the art that in a Moineau type gear pair there is a difference of one in the number of threads on the two elements. In general the outer element has had one more thread than the inner element but there have also been pumps wherein the inner element has one more thread than the outer element.

To those skilled in the field of gear trains, it will be clear that if the inner element has one less thread than the outer element, the speed change between the elements will be downward, while if the outer element has one less thread than the inner element, the speed change will be upward. It will also be obvious that the directions of rotation of the two gear elements will be the same.

The drill stem is not fixed except by the will of the operator and can be rotated at any time, when used in earth boring. Such rotation changes the oriented axis of the inner member in respect to the outer member axis without any result in performance unless it is continuous and substantial, in which case it is additive to the speed of the outer member driving the bit, thus producing a change in penetration results. The increase in speed of the bit by orbiting the axis of the inner member is inversely proportional to the number of threads on the inner and outer helical gear pair. Thus in addition to the fact that the device uniquely has a variable speed depending on which of the gear pair has the additional thread, it is also variable as to speed of the outer member imparted to the bit by the operator by rotating the conventional drill stem. This is unique because of the far greater range of variation thus available than with the use of conventional down-hole motors. This variation is in the direction of the increase only, because the operator would not turn the drill stem to the left to deduct from the bit speed because that would tend to uncouple the drill stem with its right hand threading between sections. The operator could allow the drill stem to slip backward to the left and lose ground speed at the bit, but that would also lose drilling power and be unsatisfactory, it substantial. It should also be noted that the inner member ends turn freely in its rotating movement, producing no power from rotation.

It will be clear that modifications may be made without departing from the spirit of the invention and therefore no limitation not specifically set forth in the claims is intended, and no such limitation should be implied.

What I claim is:

1. A down-hole earth drilling motor comprising a housing, a Moineau-type helical gear pair, and a water swivel having a fixed element and a rotating element, the outer helical gear of said pair being secured to said housing axially thereof and constituting the rotating element of said water swivel, the inner helical gear of said pair being disposed with its axis parallel to said outer helical gear but displaced by an amount equal to the eccentricity of the pair, a bearing element forming a part of the fixed element of said water swivel and restricting said inner helical gear against gyration but permitting rotation thereof on its lathe axis, said fixed element being secured to a non-rotating drill string, and a drill bit secured to said housing, whereby when a fluid is pumped through said motor, both inner and outer elements rotate on their respective axes but at different speeds.

2. A motor according to claim 1, wherein the number of threads on the outer helical gear differs by one from the number of threads on the inner helical gear, and the outer gear rotates at a speed inversely proportional to the number of threads on the outer and inner helical gears.

3. A motor according to claim 1, wherein the inner gear at its head end is provided with a ball on its lathe center, the fixed element of said water swivel having a box to accommodate said ball, the rotatable element of said water swivel constituting the housing for said outer helical gear, a thrust plate in said housing and a thrust button on the tail of said inner gear, bearing against said thrust plate.

4. A motor according to claim 1, wherein the outer and inner gears of said gear pair have left-hand threads, whereby they will rotate to the right, looking down the hole, thereby turning the bit to the right, whereby the effort of the inner gear to gyrate to the left exerts a tightening effort on all the right-hand threads in the drill string.

5. A motor according to claim 1, wherein the inner gear, at its head end, is provided with a ball on its lathe center, the fixed element of said water swivel having a box to accommodate said ball, a second ball on the tail end of said inner gear on its lathe center, a plate having a box to accommodate said second ball, said plate having a radial and thrust bearing in said housing, whereby when fluid is pumped through said motor said inner gear rotates on its lathe centers and is restricted against gyration by said ball and box arrangements, and said outer gear rotates on its axis at a speed inversely proportional to the number of threads on said outer and inner gears.

6. A motor according to claim 5, wherein the outer and inner gears of said gear pair have left-hand threads, whereby they will rotate to the right looking down the hole, thereby turning the bit to the right, whereby the effort of the inner gear to gyrate to the left exerts a tightening effect on all the right-hand threads in the drill stem.

7. A hydraulic motor comprising a housing, a Moineau-type helical gear pair, the outer helical gear of said pair being secured to said housing axially thereof, the inner helical gear of said pair being disposed with its axis parallel to said outer helical gear but displaced by an amount equal to the eccentricity of the pair, the inner gear, at its head end, being provided with a ball on its lathe center, a water swivel having a fixed and a rotatable element, said fixed element having a box to accommodate said ball, said rotatable element constituting the housing for said outer helical gear, a thrust plate in said housing and a thrust button on the tail of said inner gear, bearing against said thrust plate, the number of threads on the outer helical gear differing by one from the number of threads on the inner helical gear, and the outer gear rotating at a speed inversely proportional to the number of threads on the outer and inner helical gear.

8. A hydraulic motor comprising a housing, a Moineau-type helical gear pair, the outer helical gear of said pair being secured to said housing axially thereof, the inner helical gear of said pair being disposed with its axis parallel to said outer helical gear but displaced by an amount equal to the eccentricity of the pair, the inner gear, at its head end, being provided with a ball on its lathe center, a water swivel having a fixed and a rotatable element, said fixed element having a box to accomodate said ball, said rotatable element constituting the housing for said outer helical gear, a ball being provided at the tail end of said inner gear on its lathe center, a plate having a box to accomodate said last named ball, said plate having a radial and a thrust bearing in said housing, the number of threads on said outer helical gear differing by one from the number of threads on the inner helical gear, whereby when fluid is pumped through said motor, said inner gear rotates on its lathe center and is restricted against gyration by said ball and box arrangements, and said outer gear rotates on its axis at a speed inversely proportional to the number of threads on said outer and inner gears.

* * * * *